United States Patent [19]

Mashaw, Jr.

[11] Patent Number: 4,944,345

[45] Date of Patent: Jul. 31, 1990

[54] WELL DEVICE LOCK MANDREL AND RUNNING TOOL

[75] Inventor: Howard R. Mashaw, Jr., Carrollton, Tex.

[73] Assignee: Otis Engineering Corporation, Dallas, Tex.

[21] Appl. No.: 320,965

[22] Filed: Mar. 9, 1989

[51] Int. Cl.[5] ..... E21B 23/02

[52] U.S. Cl. ..... 166/206; 166/217

[58] Field of Search ..... 166/125, 217, 214, 237, 166/206

[56] References Cited

U.S. PATENT DOCUMENTS

| | | | |
|---|---|---|---|
| 2,862,564 | 12/1958 | Bostock | 166/214 |
| 4,396,061 | 8/1983 | Tamplen et al. | 166/217 |
| 4,437,522 | 3/1984 | Krause, Jr. et al. | 166/217 |
| 4,545,434 | 10/1985 | Higgins | 166/217 |
| 4,583,591 | 4/1986 | Krause, Jr. et al. | 166/382 |
| 4,595,054 | 6/1986 | Schroeder | 166/237 |
| 4,745,974 | 5/1988 | Higgins | 166/217 |
| 4,823,872 | 4/1989 | Hopmann | 166/217 |

*Primary Examiner*—Bruce M. Kisliuk
*Attorney, Agent, or Firm*—Johnson & Gibbs

[57] ABSTRACT

A lock mandrel for selectively locking a well tool at a desired landing nipple in a well bore, and a running tool for installing the lock mandrel. The lock mandrel includes an upwardly operable expander sleeve for locking the mandrel responsive to an upward force and a selector key assembly for landing the lock mandrel at a landing nipple having a selector profile compatible with the profile on the selector keys of the lock mandrel. The running tool includes a latch key assembly for coupling the running tool with the lock mandrel and an operator lug assembly for operating the lock mandrel. The running tool also includes a non-load bearing shear pin for holding the running tool in a running mode and a emergency release apparatus for releasing the lock mandrel in the well bore and retrieving the lock mandrel with the running tool in the event that the locking mechanism of the lock mandrel is not fully operable in the well bore.

20 Claims, 12 Drawing Sheets

WELL DEVICE LOCK MANDREL AND RUNNING TOOL

FIELD OF THE INVENTION

This invention relates to improvements in look mandrels and a running tool for installing such lock mandrels for releasably anchoring a variety of well devices at selected depths in a well bore.

HISTORY OF THE PRIOR ART

In the completion, servicing, and production of petroleum oil and gas wells and similar type wells, it is frequently necessary to install various well devices in landing nipples at selected depths along a string of pipe in the well bore. A number of such devices are known in the oil and gas industry. Those devices currently available, however, present operational problems. For example, prior U.S. Pat. 2,862,564, issued Feb. 21, 1955, discloses an anchoring device for well tools which is lockable by applying a downward force to the device when it has landed at a desired nipple in the well bore flow conductor. When such a device is locked by a downward force, it will be apparent that upward flow in the well could tend to release the device. Further, such device includes selector keys and locking dog apparatus which occupies a significant radial thickness of the device, thus, reducing the bore through the device through which well fluids must flow. Another prior art lock mandrel and a handling tool for the mandrel is shown in U.S. Pat. 4,745,974, issued May 24, 1988. The lock mandrel disclosed in this patent is lockable responsive to an upward force, and thus, solves the problem of inadvertent release by well fluids flow. The handling tool for the device, however, requires coaction with a safety valve supported from the lock mandrel requiring that operating fluid pressure be conducted to the safety valve, to permit the handling tool to be released from the lock mandrel. Such a handling tool, thus, is not operable with other well devices which do not include the fluid operated system which co-acts with the handling tool for release of the handling tool. Still other prior art devices similar to the present invention are shown in U.S. Pat. 4,545,434, issued Oct. 8, 1985, and U.S. Pat. 4,595,054, issued June 17, 1986. Another locking apparatus is illustrated in U.S. Pat. No. 4,583,591, issued Apr. 22, 1986. The lock mandrel and running tool of the present invention offers several improved features over the prior art devices disclosed in the above identified patents.

SUMMARY OF THE INVENTION

It is a principal object of the invention to provide new and improved well tools.

It is a particularly important object of the invention to provide a new and improved lock mandrel and a new and improved running tool for such lock mandrel, for use in wells to releasably lock well devices at landing nipples at selected depths locations along a well flow conductor.

It is another object of the invention to provide a lock mandrel for well devices which has a maximum size bore for flow of well fluids through the device.

It is another object of the invention to provide a lock mandrel for well devices which is lockable in response to an upward force.

It is another object of the invention to provide a lock mandrel for well devices which is not accidentally released by upward fluid flow through the device in a well bore.

It is another object of the invention to provide a lock mandrel for a well device which is selectively locatable at desired landing nipples using selector key apparatus having minimum wall thickness to maximize the size of the bore through the device.

It is another object of the invention to provide a running tool for a well device which is releasable from the well device without any special cooperative functional relationship between the running tool and the well device, such as requiring control fluid operation of the well device to release the running tool.

It is another object of the invention to provide a running tool for a lock mandrel which has emergency features for removal of the lock mandrel and running tool in the event of malfunctions prohibiting proper locking of the mandrel at a landing nipple.

In accordance with the invention there are provided a lock mandrel for selectively locking a well device at a landing nipple at a desired depth along a well flow conductor, and a running tool for installing the lock mandrel. The lock mandrel includes a tubular body, circumferentially spaced locking dogs for radial movement between lock and release positions, a key expander sleeve movable upwardly behind the keys for expanding the looking keys, a lock ring around the expander sleeve, a detent boss on the expander sleeve for engaging the lock ring to hold the sleeve in an upward lock position, and a locator key assembly connected with the tubular body including longitudinally slotted locator keys and a cantilever type leaf spring coupled through the longitudinal slot of each key into the tubular body in a plane substantially coincident with the plane of the key. The running tool includes a head assembly for supporting the tool from a tool string, an outer tubular body assembly coupled with the head assembly, a latch key assembly on the body assembly for releasably coupling the running tool with a lock mandrel, an operator lug assembly on the body assembly for operating the lock mandrel to lock the lock mandrel at a landing nipple, a core assembly in the body assembly coupled with the head assembly for manipulating the latch key assembly and the operator lug assembly for landing and locking the lock mandrel and thereafter releasing the running tool from the lock mandrel, non-load bearing shear pin means coupling the outer tubular body assembly with the core assembly, and releasable latch lug means between the tubular body assembly and the core for supporting the load of the lock mandrel and the well device connected to the lock mandrel during the running mode through the outer body assembly and the upper end of the core to the head assembly bypassing the shear pin and for transferring such load to the core assembly from the outer tubular body after severance of the shear pin for setting the lock mandrel and for releasing the running tool from the lock mandrel. More specifically, the running tool includes a fishneck for connection of the tool to a wireline tool string, a retainer core slidably telescoped into the fishneck, a top sub on the retainer core below the fishneck, a shear pin between the retainer core and the sub, an upper shifting sleeve connected at an upper end thereof into the retainer core, an upper lug retainer on the upper end portion of the upper shifting sleeve and slidably telescoped into the top sub, a lock-out pin assembly on the top sub for releasably locking the top sub with the upper lug retainer, a latch key retainer connected at an upper end into the lower end of the upper lug retainer, radially movable latch keys supported from the latch key retainer for releasably latching the running tool with the lock mandrel, an upper latch lug carried by the upper lug retainer and latchable with the upper shifting sleeve, an outer core telescoped into the upper shifting sleeve for longitudinal movement relative to the upper shifting sleeve, a retainer pin between the latch key retainer and the outer core, an inner core telescoped into the outer core, a spring between the upper end of the inner core and the outer core biasing the inner core downwardly relative to the outer core, a lower shifting sleeve on the outer core releasably connected into the lower end of the upper shifting sleeve within the latch keys, a lug carried by the outer core and radially movable between a latch relation with the lower shifting sleeve and the inner core, for emergency release of the running tool and lock mandrel and operator lugs carried by the lower shifting sleeve and movable between inner-release positions and outer latch positions for engaging the locking sleeve of the lock mandrel.

The lock mandrel is latched on the running tool with the latch keys of the running tool engaged in the fishneck of the lock mandrel and the operator lugs of the running tool engaged with the locking sleeve of the lock mandrel. The lock mandrel and running tool are lowered in a well bore flow conductor until the locator keys of the lock mandrel reach a flow conductor landing nipple having an inner profile compatible with the profile on the locator keys. The locator keys spring outwardly engaging the landing nipple profile, stopping the lock mandrel at the landing nipple. The running tool is then manipulated to raise the lower shifting sleeve of the running tool with the operator lugs pulling the locking sleeve of the lock mandrel upwardly expanding the locking dogs of the lock mandrel to releasably lock the lock mandrel in the landing nipple. The running tool is then manipulated for release of the running tool from the lock mandrel and retrieval from the well bore. In the event that the locking dogs of the lock mandrel are unable to fully expand into the locking recess of the landing nipple shear screws in the running tool shear permitting the running tool and lock mandrel to be retrieved to the surface.

BRIEF DESCRIPTION OF THE DRAWINGS

Details of preferred embodiments of the invention together with its objects and advantages will be better understood from the following specification taken in conjunction with the accompanying drawings wherein.

FIGS. **20*a*–20B form a fragmentary longitudinal view in section of the third operational stage of the emergency release of the lock mandrel and running tool.

DETAILED DESCRIPTION OF THE PREFERRED EMBODIMENT

Figure 1:
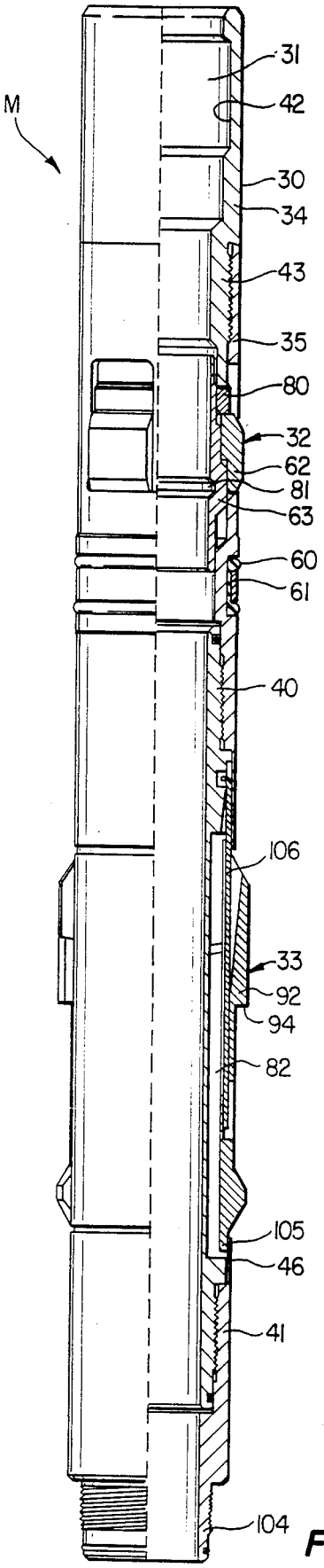
FIG. 1 is a side view in section and elevation of the lock mandrel of the invention showing the mandrel locking dogs at expanded locked positions.
Figure 3:
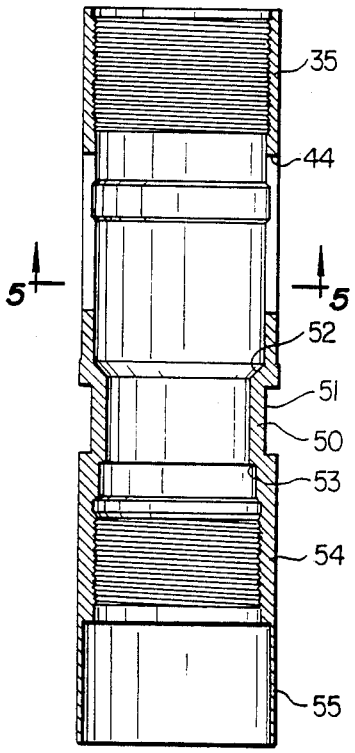
FIG. 3 is a longitudinal view in section of the dog retainer of the lock mandrel.
Figure 4:
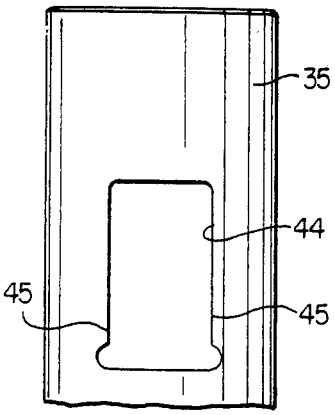
FIG. 4 is a fragmentary side view in elevation of the upper end portion of the dog retainer showing the dog window.
Figure 5:
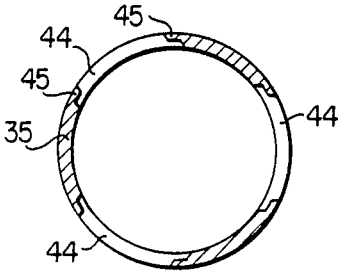
FIG. 5 is a view in section of the dog retainer along the line 5—5 of FIG. 3.

Referring to FIG. 1, a lock mandrel M has a tubular body 30 having a bore 31, a locking dog assembly 32 for releasably locking the mandrel M at a selected landing nipple along a well flow conductor, not shown, and a locator key assembly 33 for selectively landing the lock mandrel at a desired landing nipple having a compatible internal locator key profile. Typically, the lock mandrel M is useful to releasably lock a variety well tools along a well flow conductor at a desired landing nipple, such as shown in FIG. 1 of U.S. Pat. No. 2,862,564, issued Dec. 2, 1958, to J. H. Bostock. FIG. 1 of such patent shows a longitudinally spaced arrangement of well tool landing nipples connected into a well flow conductor, each nipple having a different internal locator key profile so that a lock mandrel M having a set of locator keys corresponding with a particular landing nipple will land at such nipple. Referring back to FIG. 1 herein, the mandrel body 30 is formed by a plurality of tandem connected members including a fishneck 34, a dog retainer 35, a locator key retainer 40, and a bottom sub 41. The fishneck 34 has an internal annular recess 42 engagable by latch keys on the running tool of FIG. 13A. The lower end portion 43 of the fishneck is reduced and externally threaded for connection into the upper end portion of the dog retainer 35. Referring to FIGS. 3–5, the dog retainer 35 is a tubular sleeve having a plurality of circumferentially spaced look dog windows 44 which are undercut along opposite sides providing a longitudinal retainer flange 45 along each of the vertical sides of the windows. The flanges 45 cooperate with longitudinal flanges, not shown, on locking dogs in the assembly 32 to retain the dogs in the windows 44 in the manner shown in detail in U.S. Pat. No. 4,545,434. The sleeve 35 has a central reduced diameter portion 50 which is provided with an external annular seal ring recess 51. Internally, the sleeve 35 is provided with a downwardly and inwardly tapered stop shoulder 52 at the upper end of the reduced section 50. The lower end of the reduced section 50 provides a downwardly facing internal annular stop shoulder 53. The lower end portion of the sleeve 35 includes an internally threaded section 54 and a thin downwardly extending skirt section 55. The externally threaded upper end portion of the locator key retainer sleeve 40 is threaded into the internally threaded section 54 of the sleeve 35. Referring back to FIG. 1, a molded seal 60 is fitted in the recess 51 of the sleeve 35. A snap ring 61 fits around the molded seal 60 retaining the seal in the recess 51. As evident in FIG. 1, the seal 60 has semi-circular seal portions at opposite ends between which the snap ring 61 fits for holding the seal in place while the semi-circular end portion seal with a surface around the mandrel M, such as a seal surface in a landing nipple in which the mandrel is locked.

Figure 2:
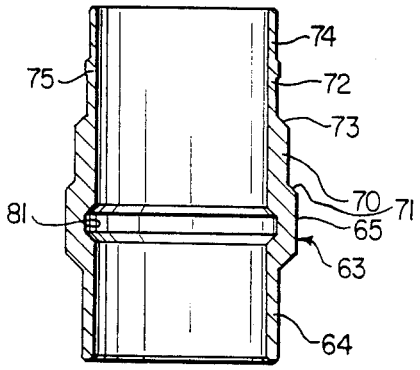
FIG. 2 is a longitudinal view in section of the looking sleeve of the mandrel of FIG. 1.

The locking dog assembly 32 is mounted in the dog retainer sleeve 35 as illustrated in FIG. 1. A locking dog 62 is mounted in each of the windows 44 of the sleeve 35 around a tubular locking sleeve 63 illustrated in detail in FIG. 2. Referring to FIG. 2, the locking sleeve 63 has a lower end guide portion 64 which telescopes into the reduced section 50 of the sleeve 35 below the tapered stop shoulder 52. The locking sleeve has a 3-step graduated central locking and locking dog expander portion defined by a first section 65, a second smaller section 70, a tapered cam surface 71 between the sections 65 and 70, a still smaller section 72, and a tapered cam surface 73 between the sections 70 and 72. A further reduced upper end guide portion 74 telescopes into the lower end portion of the fishneck 30 as seen in FIG. 1. An annular detent boss 75 is provided at the upper end of the sleeve section 72. A split detent ring 80 is mounted around the locking sleeve 63 for co-action with the latch boss 75 to releasably hold the locking sleeve 63 at the upper locking position shown in FIG. 1. Each of the locking dogs 62 has a two step graduated bore, as evident in FIG. 1, for co-action with the expanding and locking surfaces on the sleeve 63, so that the locking dogs are fully supported by the graduated surfaces on the sleeve 63 at both the retract release position and the expanded locking position. The two cam surfaces 71 and 73 on the sleeve 63 provide uniform expansion of the dogs 62 upon upward movement of the sleeve 63. The sleeve 63 has an internal annular operating recess 81 for engagement of an operator lug on the running tool illustrated in FIGS. 13A–13B. The upper skirt portion 74 slides within an enlarged lower end portion of the fishneck section 43 with the bore through the sleeve 63 being of substantially the same diameter as the bore through the fishneck section 43, so that the bore 31 throughout the length of the mandrel M below the fishneck section 34 is of maximum, substantially uniform, diameter.

Figure 8:
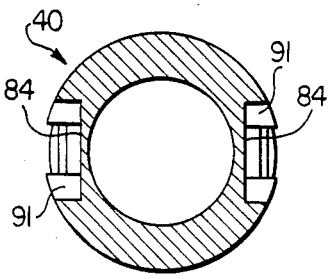
FIG. 8 is a view in section of the locator key retainer along the line 8—8 of FIG. 6.
Figure 6:
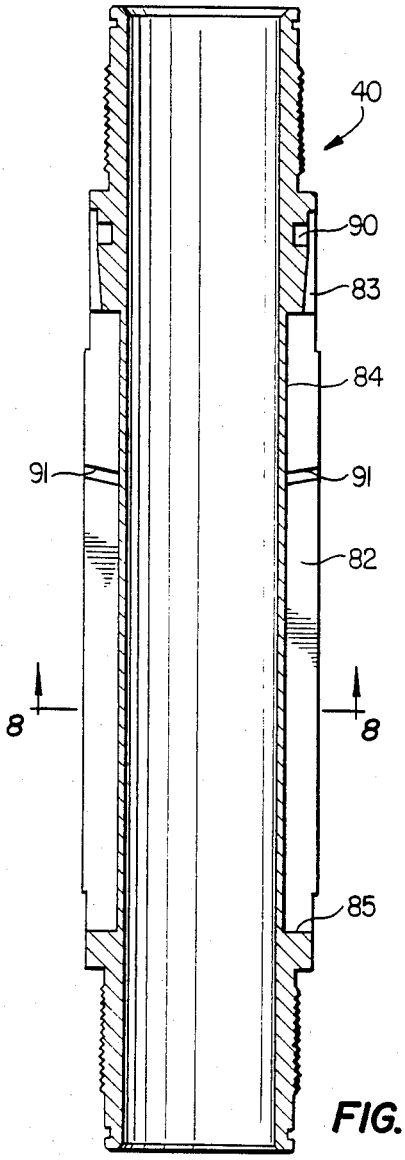
FIG. 6 is a longitudinal view in section of the locator key retainer sleeve of the lock mandrel.
Figure 7:
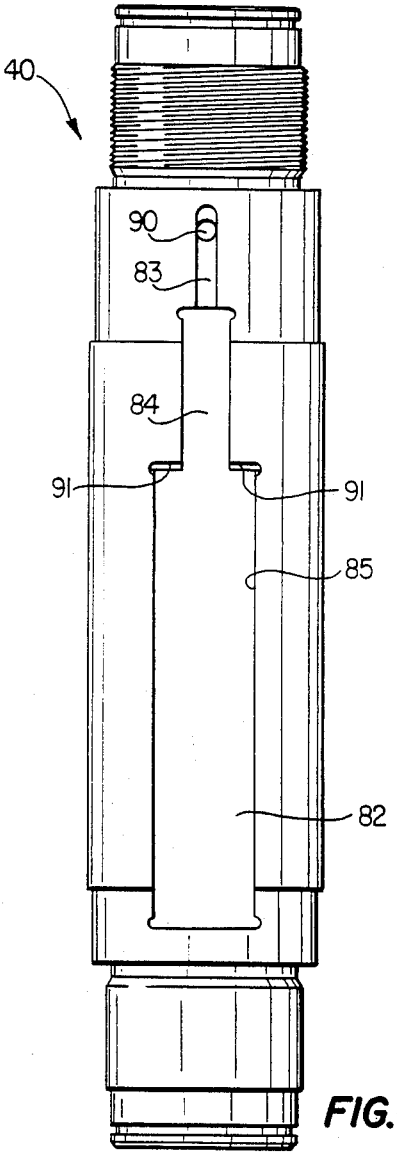
FIG. 7 is a side view in elevation of the locator key retainer of FIG. 6.
Figure 9:
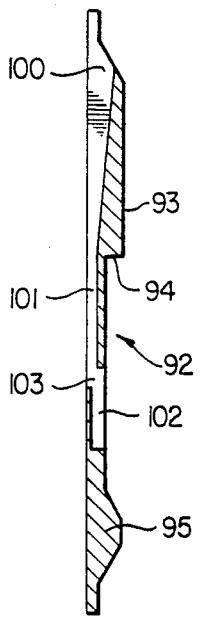
FIG. 9 is a longitudinal view in section of one of the locator keys of the lock mandrel.
Figure 10:
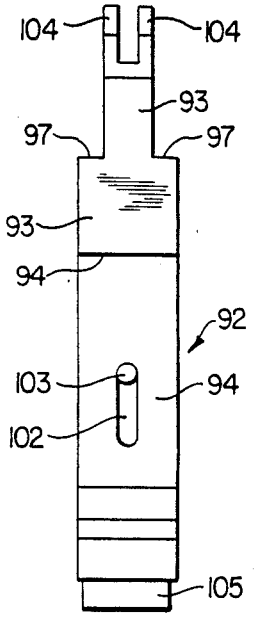
FIG. 10 is an outside side view in elevation of the locator key of FIG. 9.
Figure 11:
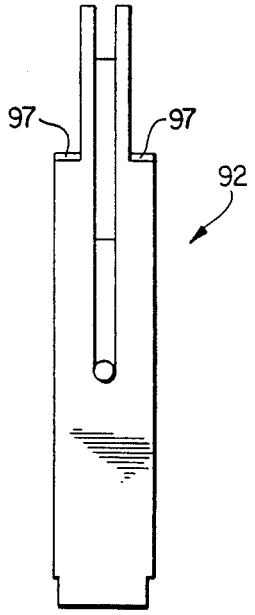
FIG. 11 is an inside side view of the locator key of FIGS. 9 and 10.
Figure 12:
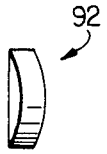
FIG. 12 is a bottom end view of the locator key of FIGS. 9–11.

Referring to FIG. 1, the upper end portion of the locator key retainer 40 is threaded into the lower end portion of the dog retainer sleeve 35. Details of the structure of the locator key retainer 40 are shown in FIGS. 6–8. The key retainer has longitudinal, outwardly opening, locator key pockets 82 defined by a key spring latch portion 83, a tongue portion 84, and a main body portion 85. As seen in both FIGS. 6 and 7, the spring latch portion 83 includes a blind hole 90. The upper end of the body section 85 is defined by upwardly sloping cam services 91 on opposite sides of the opening of the body section into the tongue section 84. The cam surfaces 91 co-act with a locator key 92 positioned in each of the pockets 82, as seen in FIG. 1. The details of each of the locator keys 92 are shown in FIGS. 9–12. Each locator key has a tongue section 93 and a body section 94 which fit in the tongue and body sections 84 and 85 of the locator key retainer pockets 82. Referring to FIG. 9, each locator key 92 has an outer key profile defined by an upper section 93, a stop shoulder 94, and a lower section 95 spaced below the stop shoulder. The profile defined by the section 93, the stop shoulder, and the spaced section 95 is compatible with an internal annular profile in a landing nipple, not shown, located at the desired depth in the well at which the mandrel M is to be landed and locked. Each key 92 has a spring slot defined by an inwardly and upwardly opening section 100, a central section 101, and an outwardly opening lower end section 102 communicating with the central inwardly opening section 101 by a hole 103. As evident in FIGS. 10 and 11 the upper end of the key 92 has a two-prong fork shape defined by spaced prongs 104. At the base end of the forked section, each key has downwardly, inwardly sloping cam surfaces 97 engageable with the retainer surfaces 91 to urge the key outwardly. The lower end of each key 92 is defined by a downwardly extending retainer foot 105. The tongue section 93 of each key 92 fits in the tongue section 84 of the pocket 82 in the locator key retainer 40 while the body 94 of the key fits in the body section of the body section 85 of the pocket. The lower end portion of the key retainer 35 forms a skirt which extends downwardly over the upper end portions of the fork or prongs 101 on the upper end of each of the keys 92, as seen in FIG. 1. A leaf spring 106 is mounted in each key 92. Each leaf spring extends upwardly along the key slot section 100, and hooks at the upper end inwardly into the key retainer hole 90. The spring extends along the key slot section 100, the slot section 101, through the hole 103 and along the outwardly opening key slot section 102. Thus, each spring 106 extends along the inside of each key 92, through the key slot sections 100 and 101, and a short lower end portion of the spring extends along the outside in the outwardly opening key slot section 102 of the key. The lower end portion of the key retainer 40 threads into the bottom sub 41, as seen in FIG. 1. The bottom sub has an upwardly extending, thin-walled, skirt portion 46 inside of which the lower foot end 105 of each key 92 fits. Thus, the upper ends of the forks 104 and the lower foot end 105 of each key fit behind the lower end skirt portion of the key retainer 35 at the upper end of each key and behind the skirt portion 46 on the bottom sub 41 at the lower end of each key, thereby restraining the outward movement of each key to the position shown in FIG. 1 at which position the spring 106 resiliently holds the key in an essentially vertical outward position. The depth of each of the key pockets 82 is sufficient that each key may move inwardly against the outward bias of the spring 106 to clear or pass through landing nipple profiles which are not compatible with the keys 92, as illustrated. In other words, as the keys reach a landing nipple profile into which the keys will not fit, the various surfaces along the landing nipple profile will press each key inwardly into the pocket 82 sufficiently for the keys to clear and pass through the particular landing nipple at which the mandrel M is not designed to land. This arrangement permits the keys to be held resiliently outward as the mandrel M moves down a flow conductor so that the keys drag along seeking a landing nipple profile into which the keys will fit. The upwardly facing inwardly sloping cam surfaces 97, FIGS. 10 and 11, co-act with the cam surfaces 9 in the key pockets 82, urges the keys outwardly as the mandrel moves down a flow conductor and the keys drag along the inner surface of the conductor. The combined action of the springs holding the keys outwardly and the contacting surfaces 91 on the key retainer sleeve 40 and the key cam surfaces 97 on the keys resiliently hold the keys outward as they drag along a flow conductor wall seeking a compatible landing nipple profile. Of course, when such profile is reached the keys snap into the profile with the stop shoulders 94 on the keys engaging a corresponding stop shoulder, not shown, in a landing nipple stopping the downward movement of the mandrel M. It will be evident in FIG. that the locator keys, and the locator keys springs nest together and fit within the retainer sleeve pocket 82 utilizing minimum wall thickness along the mandrel, so that the bore 31 of the mandrel through the locator key assembly 33 can be uniform with the other portions of the bore and of maximum diameter.

As seen in FIG. 1, the lower end of the bottom sub 41 is reduced and externally threaded at 104 for connection of the mandrel M with a well tool, not shown, to be supported from the mandrel in a flow conductor.

It will be recognized from the description of the mandrel M, in accordance with the invention, that the well tool lock mandrel is provided which has a maximum size, uniform diameter, flow passage throughout the length of the mandrel, and a locking dog assembly lockable responsive to an upward pull so that upward well fluid flow will not tend to dislodge the mandrel, and an integral selector key assembly adapted to selectively land the mandrel at a desired landing nipple having an internal profile compatible with the selector keys. The mandrel M is run and locked in a flow conductor using the running tool R shown in detail in FIGS. 13A–13B.

Figure 13A:
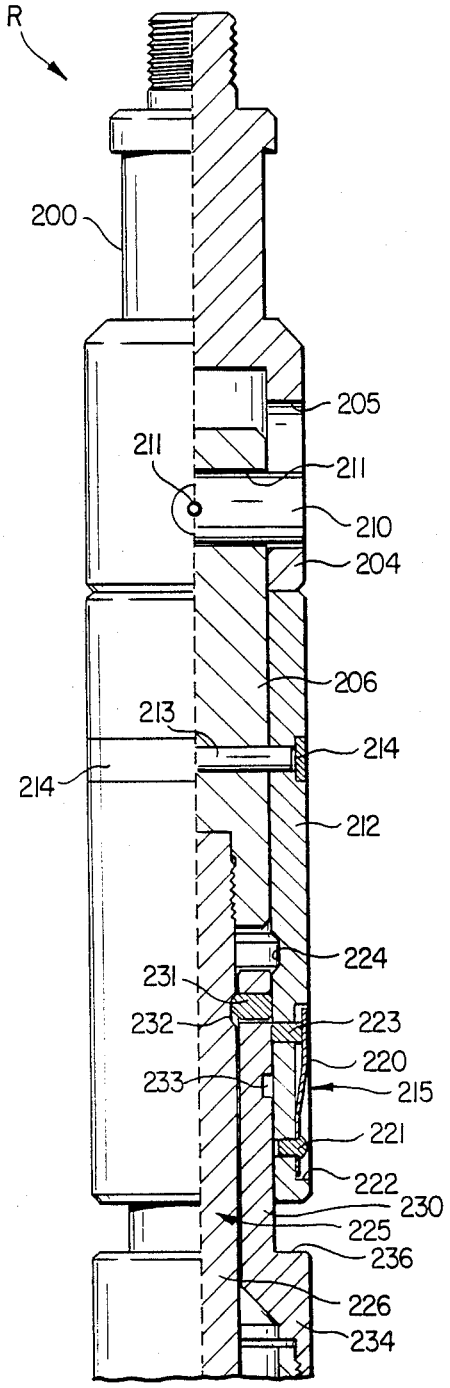
FIGS. 13A–13B together form a longitudinal view in section and elevation of the running tool for installing the lock mandrel of FIGS. 1–2.
Figure 13B:
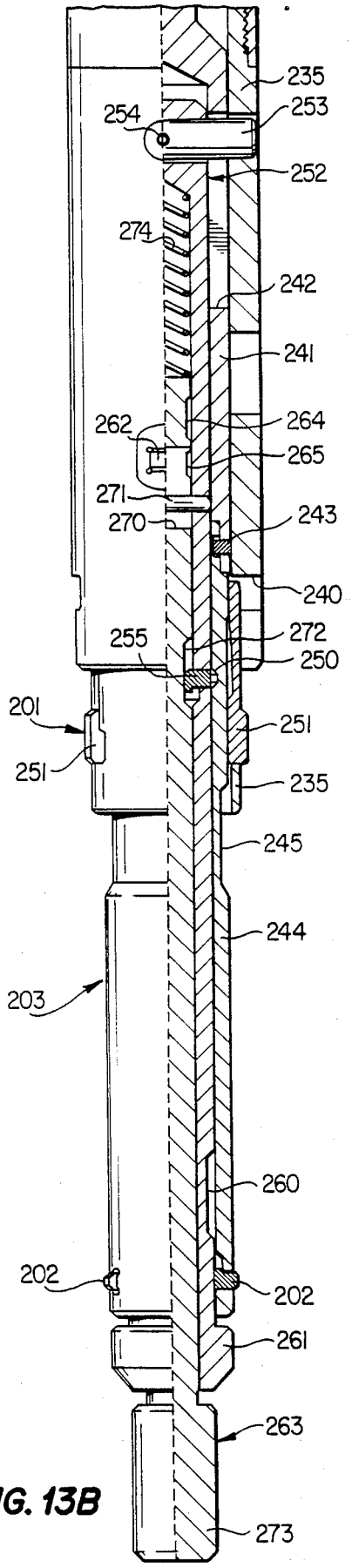

Referring to FIGS. 13A–13B, the running tool R includes a head assembly having an external fishneck 200, a latch key assembly 201 for latching the running tool into the internal fishneck 30 of the mandrel M, and operator lugs 202 on an operator probe assembly 203 of the running tool for manipulating the locking sleeve 63 of the mandrel M to lock and release the mandrel at a desired landing nipple. The operation of the probe assembly 203 of the running tool R performs multiple functions including the expansion and contraction of the latch key assembly 201, and of the operator lugs 202, during the various steps of landing and locking the mandrel M and the normal and emergency release modes of operation of the mandrel M.

As shown in FIG. 13A, the fishneck 200 has an enlarged skirt 204 provided with longitudinal transfer pin slots 205. The upper end of a retainer core 206 telescopes into the fishneck skirt 204 coupled to the fishneck skirt by a transfer pin 210 disposed through a transverse bore 211 of the core 204 and connected with the core by a set screw 211. The opposite outward ends of the transfer pin 210 extend into the fishneck slots 205 coupling the core 204 with the fishneck while permitting relative longitudinal movement between the core and the fishneck. A tubular top sub 212 telescopes along an upper portion over the core 206 and is pinned to the core by a shear pin 213. The opposite outer ends of the shear pin 213 are recessed below the surface of the top sub 212. A shear pin retainer ring 214 is fitted in an external annular recess around the top sub 212 holding the shear pin 213 in the position illustrated in FIG. 13A. A lower end portion of the top sub 212 extends below the lower end of the core 206. A lock-out pin assembly 215 is installed on the lower end portion of the top sub 212. The lock-out pin assembly includes a spring 220 connected at a lower end by a cap screw 221 to the top sub. The cap screw and spring fit in a longitudinal outside pocket 222 in the lower end portion of the top sub 212. A laterally movable lock-out pin 223 is mounted beneath the spring through the lower end portion of the top sub 212 and is biased inwardly by the spring. The function of the lock-out pin 223 will be explained. An internal annular operating lug recess 224 is formed in the lower end portion of the top sub 212 above the lock-out pin assembly, as illustrated. An upper shifting sleeve 225 is threaded along a reduced upper end portion 226 into the lower end of the retainer core 206. An upper lug retainer 230 fits within the top sub 212 around the upper end portion 226 of the upper shifting sleeve 225. A latch lug 231 is carried in a window of the upper lug retainer 230 for inward and outward movement between locking positions. The upper portion of the upper shifting sleeve has an external annular upper lug recess 232. The lug 231 engages the lug recess 232 at an inward position and the recess 224 in the top sub at an outward position. The upper lug retainer 230 has a lock-out pin recess 233 for engagement by the lock-out pin 223.

Referring to FIGS. 13A–13B, the lower end portion 234 of the upper lug retainer 230 is threaded on an upper end portion of a latch key retainer sleeve 235. The lower end of the retainer sleeve 235 has circumferentially spaced latch key windows 240. The windows 240 are designed for the latch key assembly 201. The upper shifting sleeve 225 has an enlarged lower section 241 which fits in sliding relation within the latch key retainer 235. The section 241 of the upper shifting sleeve is provided with opposite, longitudinal, retainer pin slots 242. The lower end of the section 241 of the upper shifting sleeve is connected by shear screws 243 with the upper end of a lower shifting sleeve 244, the upper end of which telescopes into the lower end of the section 241 of the upper shifting sleeve. The operator lugs 202 are mounted in windows along the lower end portion of the lower shifting sleeve 244. As evident in FIG. 13B, the lugs 202 have an L-shaped inner portion limiting the outward movement of the lugs to the position shown, while allowing the lugs to move inwardly. The lower shifting sleeve 244 has an external annular latch key release recess 245 which cooperates with the latch key assembly 201 to permit the latch assembly to move inwardly to a release position. The lower shifting sleeve 244 also has an internal annular operating lug recess 250 the function of which will be explained. The latch key assembly 201 includes latch keys 251 mounted in the windows 240 around the upper shifting sleeve section 241 within the latch key retainer 235. The latch keys 251 have side flanges, not shown, and the latch key retainer sleeve 235 has side flanges along the vertical side edges of the windows 240 which retain the latch keys 251 in the windows while allowing the lower ends of the keys to expand and contract radially for latching and releasing the latch keys in fishneck 30 of the mandrel M. Such a latch key and sleeve arrangement is shown in more detail in U.S. Pat. No. 4,545,434. As shown in FIG. 13B, the latch keys 251 are at an outward locking position. When the lower shifting sleeve is moved upwardly positioning the latch key release recess 245 within the latch keys 251, the latch keys are free to move inwardly to release positions.

Referring to FIGS. 13A–13B, an outer core 252 is telescoped into the lower, upper shifting sleeve section 241 through the lower shifting sleeve 244. The outer core 252 is a tubular member closed at the upper end and coupled with the key retainer 235 by a retainer pin 253 which extends laterally across the upper end portion of the outer core and is connected to the core by a set screw 254. The pin 253 passes through the longitudinal slots 242 in the upper shifting sleeve sections 241. A lower shifting sleeve latch lug 255 is carried in a side window of the outer core 252 for radial movement inwardly and outwardly between a release position and an outward position engaging the operating recess 250 within the lower shifting sleeve 244. The lug 255 has a side flange limiting the outward movement of the lug in the window of the outer core. The outer core has an external annular release recess 260 which permits inward movement of the operator lugs 202 carried by the lower shifting sleeve 244. The lower end of the outer core 252 is enlarged providing an annular, flange 261. As shown in FIG. 13B, and more clearly in FIG. 14B, inner core latch lugs 262 are mounted in side windows of the outer core 252. The lugs 262 are aligned at opposite sides of the core at 90 degree angles to the lugs 255. The lugs 262 have inner bosses or latch portions which project inwardly into the bore of the outer core for purposes which will be explained.

Continuing reference to FIG. 13B, an inner core 263 is telescoped into the outer core 252 for longitudinal movement relative to the outer core. The inner core has an external annular operating recess 264 spaced below the upper end thereof and an operating recess 265 below the recess 264. A longitudinal slot 270 extends laterally through the inner core below the recess 265 for a roll pin 271 connected at opposite ends into the outer core 252 coupling the inner core to the outer core, while permitting limited longitudinal movement of the inner core relative to the outer core. The inner core has a lug recess 272 engageable by the lug 255. The lower end of the inner core is enlarged at 273 below the enlarged lower end portion 261 of the outer core 252. A spring 274 within the upper end portion of the bore of the outer core 252 bears against the upper end of the inner core 263 biasing the inner core downwardly relative to the outer core.

Figure 14A:
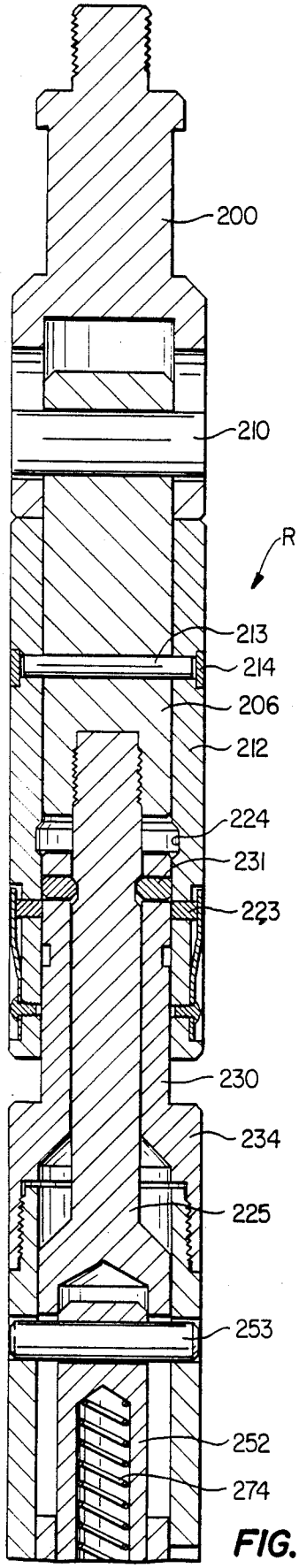
FIGS. 14A–14B form a fragmentary longitudinal view in section of the lock mandrel coupled with and supported from the running tool in the running mode used for installing the look mandrel in a landing nipple of a well flow conductor.
Figure 14B:
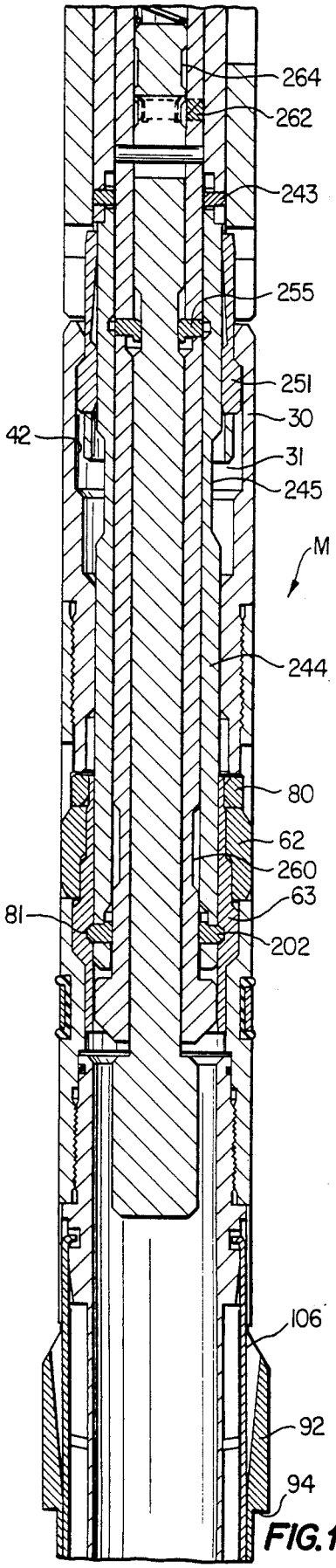

In operation, the mandrel M is attached to a well tool, not shown, to be installed in a well flow conductor and locked in place in a landing nipple by means of the mandrel. The well tool is connected to the mandrel M at the threaded section 104 of the bottom sub 41. The mandrel M is installed on the running tool R as seen in FIGS. 14A–14B. To install the mandrel on the running tool, the lower shifting sleeve 244 of the running tool must be moved to a position at which the release recess 245 is aligned within the heads of the latch keys 251 and the lugs 202 are aligned with the release recess 260. The shear pin retainer ring 214 is rotated so the shear pin 213 can be removed from the head of the running tool and the fishneck 200 is pulled upwardly lifting the transfer pin 210, the retainer core 206, the upper shifting sleeve 225, and the lower shifting sleeve 244. Initially, the upper lug retainer 230 is lifted until the lug 23 is aligned with the recess 224 at which time the upper lug retainer 230 would engage the lower end of the top sub 212. The lug 231 is cammed outwardly into the recess 224 releasing the upper shifting sleeve and lower shifting sleeve to move on upwardly to the upper end position of the upper shifting sleeve in the upper lug retainer at which time the recess 245 is within the latch keys 251 and the lugs 202 are aligned with the release recess 260. The mandrel M then can be placed on the running tool with the lower end portions of the running tool being inserted into the bore 31 of the mandrel M. The running tool is inserted into the mandrel bore until the internal fishneck 30 of the mandrel M passes over the latch keys 251 and the lugs 202 are within the locking sleeve 63 of the mandrel M aligned with the operating recess 81 of the locking sleeve. The fishneck 200 of the running tool is moved back downwardly and the shear pin 213 is re-installed and the shear pin retainer 214 is rotated 90 degrees. The locking sleeve of the mandrel M is at the lower end release position at which the locking dogs 62 are free to move inwardly. The running tool operator lugs 202 are within the locking sleeve recess 81 and the latch keys 251 are within the recess 42 of the mandrel fishneck 30. The lower shifting sleeve recess 245 is below the latch keys, so that the latch keys are held outwardly in locked position in the mandrel fishneck, and the release recess 260 is positioned above the lugs 202 so that the lugs are held outwardly in the locking sleeve recess 81. The fishneck of the running tool R is connected with a suitable tool string, not shown, for running the well tool, lock mandrel M, and running tool R into a well flow conductor. The running condition of the lock mandrel M on the running tool R is illustrated in FIGS. 14A and 14B

Figure 15A:
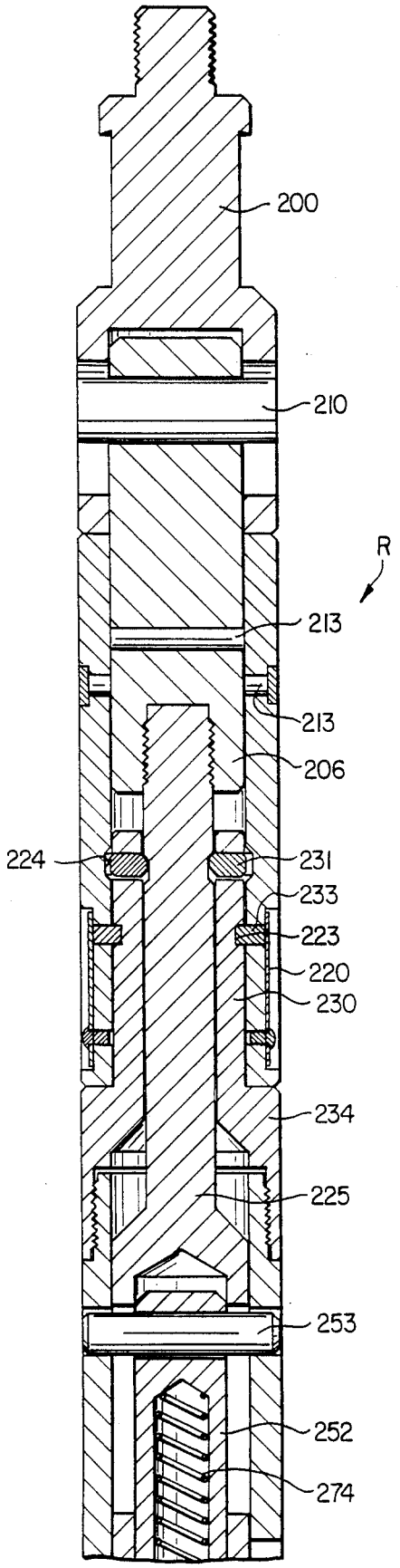
FIGS. 15A–15B together form a longitudinal fragmentary view in section of the lock mandrel on the running tool when the lock mandrel selector keys have expanded into the selected compatible landing nipple profile and at the first mode of locking the lock mandrel in the landing nipple.
Figure 15B:
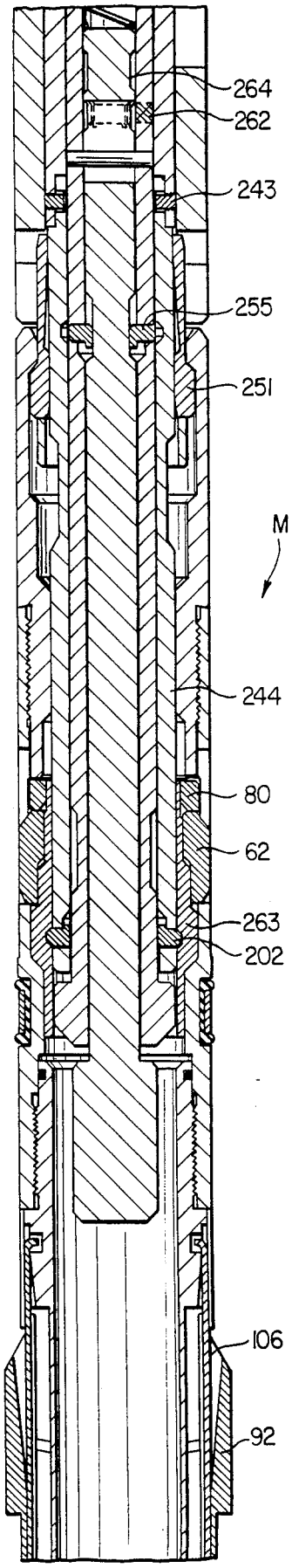
Figure 16A:
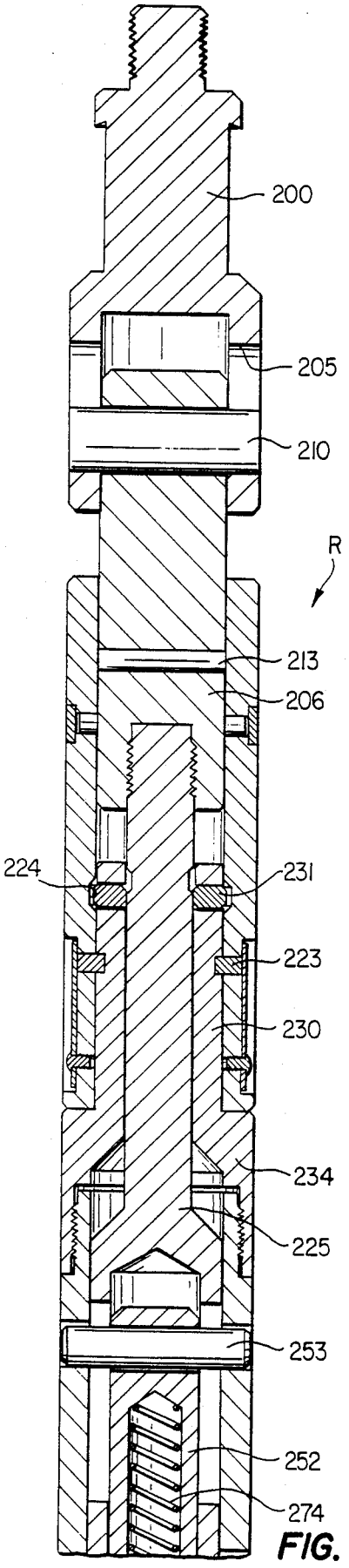
FIGS. 16A–16B together form a longitudinal fragmentary view in section similar to FIGS. 15A–15B showing the second stage of landing and looking the lock mandrel at the desired landing nipple.
Figure 16B:
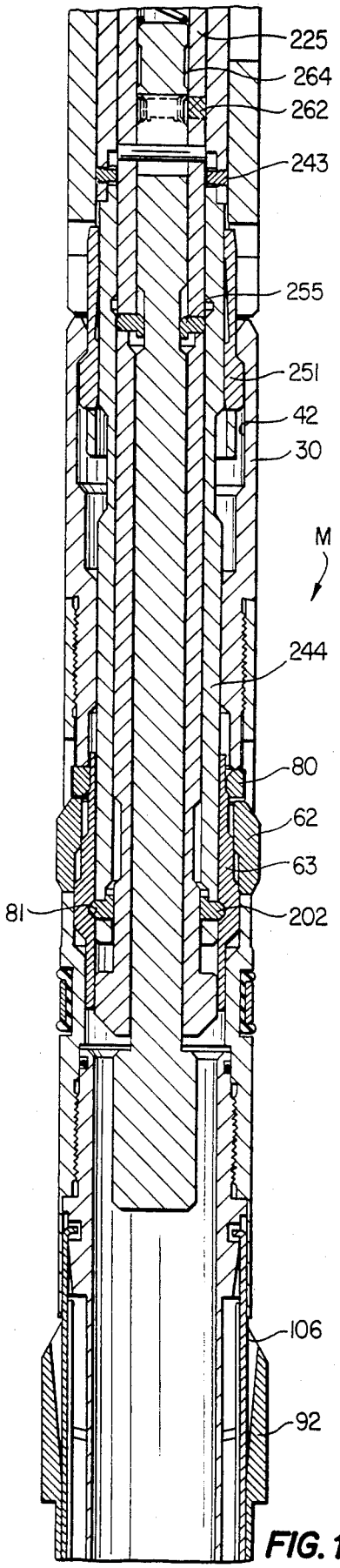

In the condition illustrated in FIGS 14A and 14B, the lock mandrel M and running tool R are lowered, in a well flow conductor, not shown. The locking dogs 62 on the mandrel M are in release condition because the locking sleeve 63 is at a lower end position. Thus, the locking dogs do not engage the locking recess of any landing nipples through which the mandrel may pass as it moves downwardly in a flow conductor. The locator keys 92, however, are held outwardly by the springs 106 so that the keys drag along the flow conductor wall. When the locator keys are aligned with an internal locator profile of a landing nipple which has the same shape as the profile on the keys, the locator keys move into the landing nipple locator profile with the stop shoulder 94 on the keys stopping the downward movement of the mandrel M, the running tool R, and the apparatus connected with the running tool and mandrel including the tool string and the well device connected on the lower end of the mandrel M. As the mandrel and running tool move down the flow conductor the mandrel and running tool and the various parts of both of the devices are spaced out as illustrated in FIGS. 14A and 14B. The weight of the mandrel M and running tool R is supported by the lugs 23 through the core 206 to the transfer pin 210. There is no weight on the shear pin 213 The entry of the mandrel M into the landing nipple having a selector profile the same as the profile on the locator keys 92, permits the locator keys to expand into the landing nipple profile and the shoulder 94 on the locator keys to arrest the downward movement of the mandrel and running tool. Upon the stopping of the downward movement of the lock mandrel, various parts of the lock mandrel and the running tool telescope to the relative positions as also shown in FIGS. 14A and 14B, with the lower end edge of the fishneck 200 on the running tool resting on the upper end edge of the top sub 212. The fishneck is then jarred downwardly applying downward force through the fishneck to the top sub 212 which is resisted by the shear pin 213. When the downward jarring force is sufficient, the pin 213 shears releasing the top sub to telescope farther downwardly until the lower end edge of the top sub engages the shoulder 236 on the upper lug retainer 230 at the lower end 234 of the reduced neck portion 230 as seen in FIG. 15A. The spring 220 pushes the lock out pin 223 into the locking recess 233 in the upper end portion of the upper lug retainer 230 thereby latching the top sub 212 to the upper lug retainer. This locks out the top sub relative to the retainer core 206 and the upper shifting sleeve 225 which is connected to the core 206. The recess 224 within the top sub is in alignment with the lug 231 so that the upper shifting sleeve which is connected into the lower end of the core 206 is free to move within the upper lug retainer. The fishneck 200 is then picked up by the tool string lifting the fishneck to the position of FIG. 16A which telescopes upwardly on the retainer core 206 because of the longitudinal slots 205 in the fishneck. The fishneck engages the transfer pin 210 which then applies the upward force to the retainer core 206 and the upper shifting sleeve 225. The sleeve 225 is connected with the lower shifting sleeve 244 by the screws 243. Continued upward pulling on the fishneck 200 pulls up on the transfer pin 210 lifting the retainer core 206 and the upward shifting sleeve 225 with the lower shifting sleeve 244 pulling the operator lugs 202 upwardly which are locked into the operating recess 81 of the lock mandrel locking sleeve 63. The upward pull on the lugs 202 pulls the locking sleeve 63 upwardly within the locking dogs 62 expanding the dogs to the position of FIGS. 16B which initially locks the dogs in the landing nipple locking recess, not shown. During this procedure the running tool latch keys 251 remain expanded in the recess 42 of the lock mandrel fishneck 30 so that the running tool is still coupled with the lock mandrel while the lock mandrel dogs 62 are being initially expanded to locking positions. The latch keys 251 are not releasable until the locking dogs 62 are fully expanded and locked. The jarring down, of course, shearing the pin 213 shifts the top sub 212 downwardly to line the recess 224 up with the lugs 231 which allows the lugs 231 to move outwardly, therefore uncoupling the upper lug retainer 230 from the upper shifting sleeve, 225.

Figure 17A:
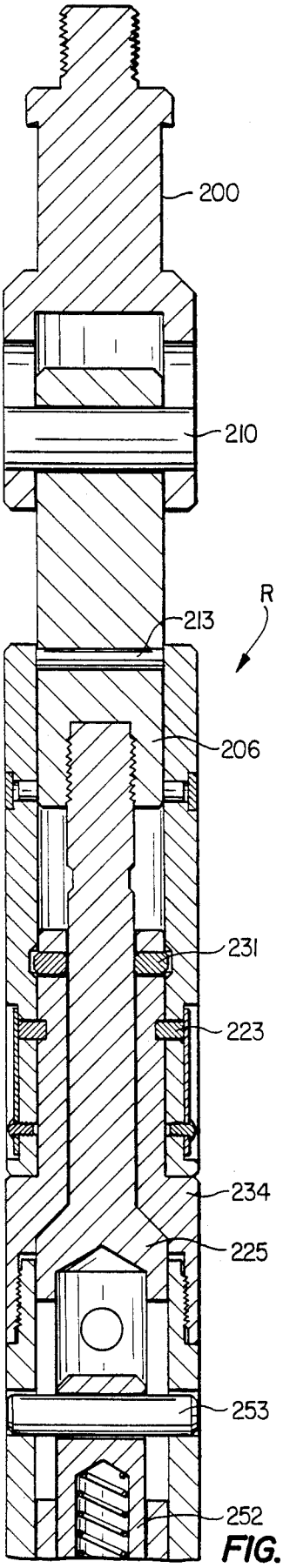
FIGS. 17A–17B together form a longitudinal fragmentary view in section illustrating locking the lock mandrel and releasing of the running tool from the lock mandrel after the lock mandrel is fully set and locked at a landing nipple.
Figure 17B:
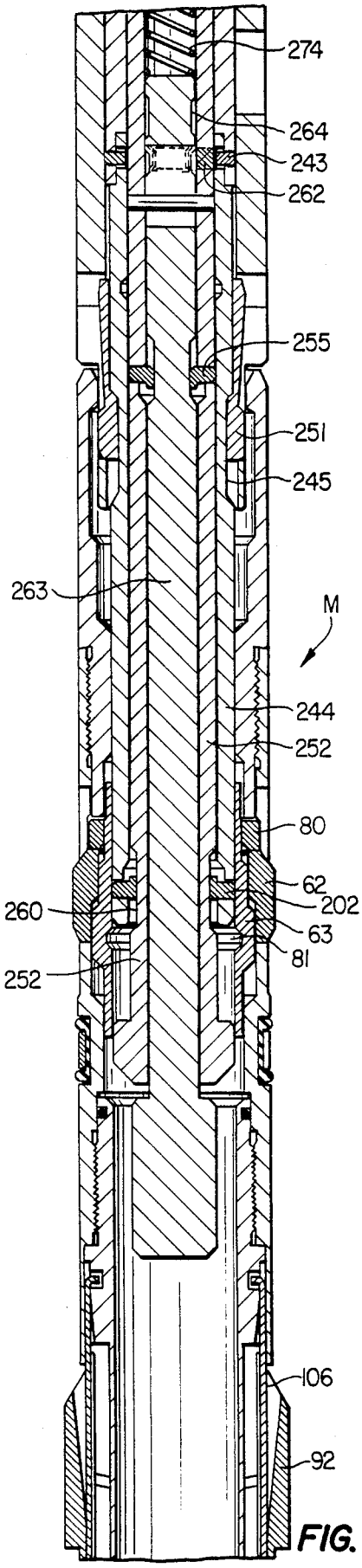

As previously, indicated the upward pull on the running tool fishneck 200 pulls the lugs 202 upwardly in the sleeve 63 of the lock mandrel M expanding the locking dogs 62. When the lugs 202 are pulled upwardly sufficiently, the sleeve 63 moves through the lock ring 80 until the locking boss on the sleeve is at an upper latch position in the ring 80 fully locking the dogs 62 outwardly and the latching sleeve 63 at the upper latch position. Friction and gravity tends to hold the running tool and lock mandrel at the landed position until initial upward pull moves the locking dogs 62 fully outward into the landing nipple landing recess. The locking dogs 62 now hold the lock mandrel in the landing nipple while the mandrel is being locked. The locking of the lock mandrel in the landing nipple and the release of the running tool from the lock mandrel is represented in the two stages shown in FIGS. 16A and 16B, and 17A and 17B, though the actual procedural steps represented are continuous with the jarring upwardly. Such upward jarring lifts the lower shifting sleeve 244 to the position of FIGS. 17B at which the release recess 245 on the sleeve is within the lower heads of the latch keys 251 allowing the latch keys to compress inwardly around the lower shifting sleeve releasing from the internal fishneck of the mandrel, and additionally, aligning the lugs 202 with the release recess 260 around the outer core 252 sO that the lugs 202 move radially inwardly out of the locking recess 81 of the sleeve 63 of the lock mandrel M. This inward movement of the lugs 202 releases the running tool from the locking sleeve 63 of the lock mandrel. The positions of the various parts of the running tool and lock mandrel at this stage of release of the running tool from the lock mandrel are illustrated in FIGS. 17A and 17B. The running tool is then pulled back to the surface leaving the lock mandrel locked by means of the dogs 62 in the landing nipple.

Figure 18A:
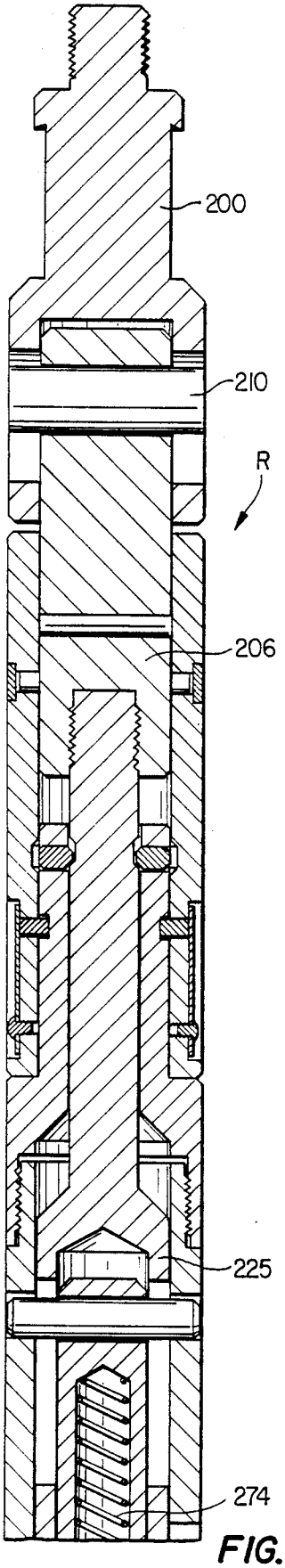
FIGS. 18A–18B together form a longitudinal fragmentary view in section illustrating a first stage of the emergency release of the running tool and lock mandrel when the locking dogs of the lock mandrel will not properly fully expand for locking the mandrel at a landing nipple.
Figure 18B:
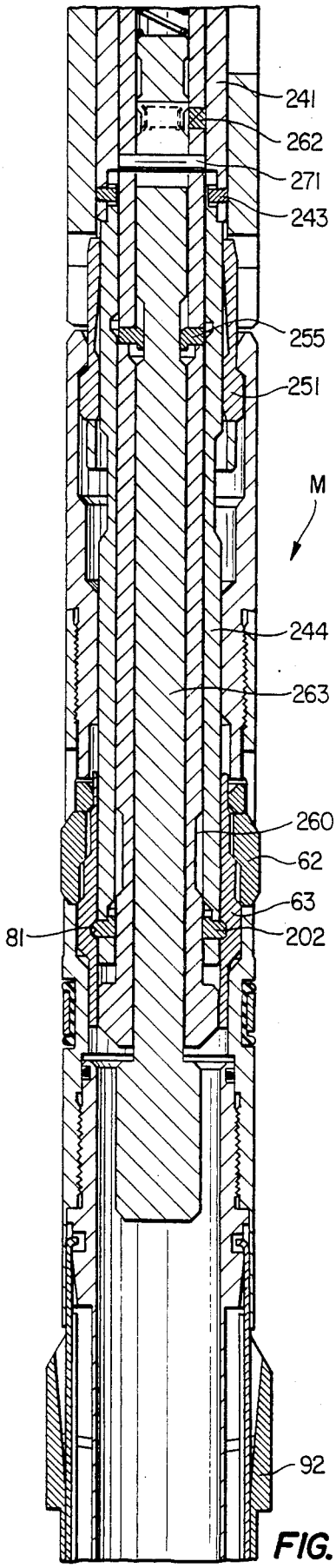
Figure 19A:
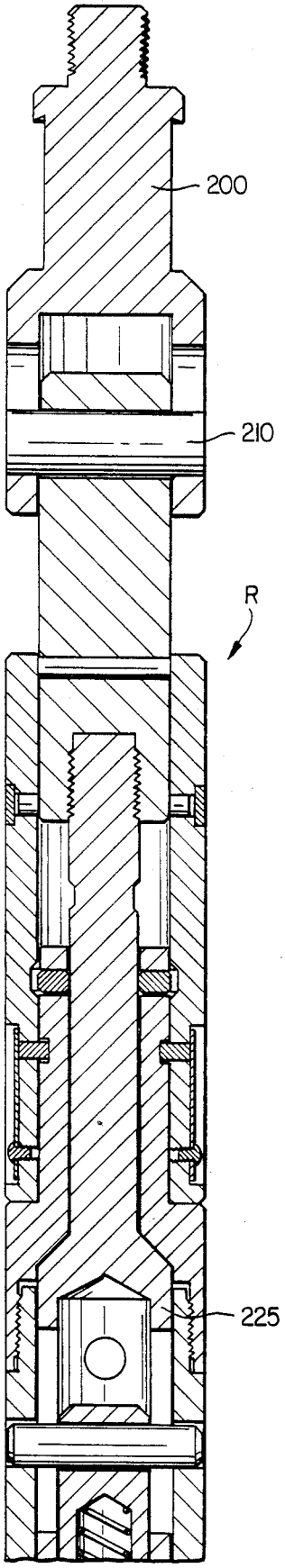
FIGS. 19A–19B together form a longitudinal view in fragmentary section showing the second operational stage of the emergency release of the lock mandrel and running tool.
Figure 19B:
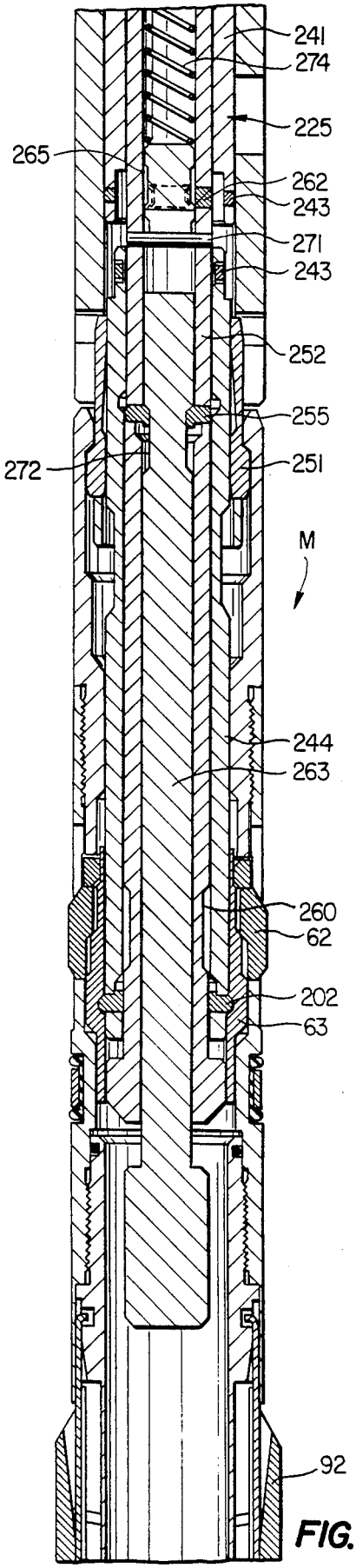
Figure 20A:
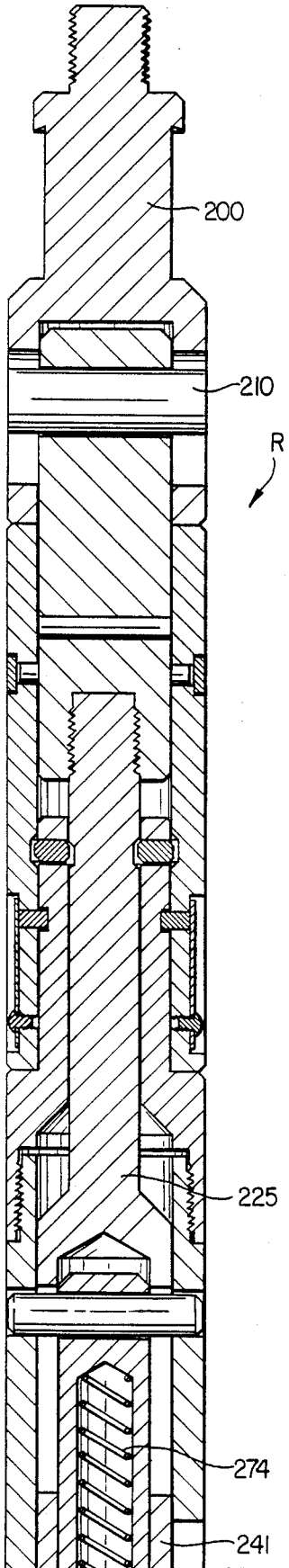
Figure 20B:
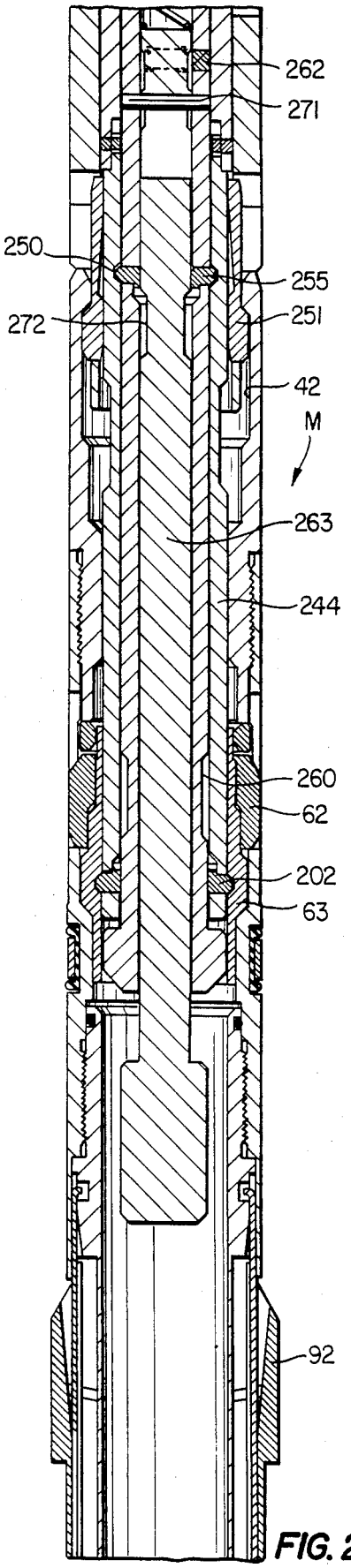
Figure 21A:
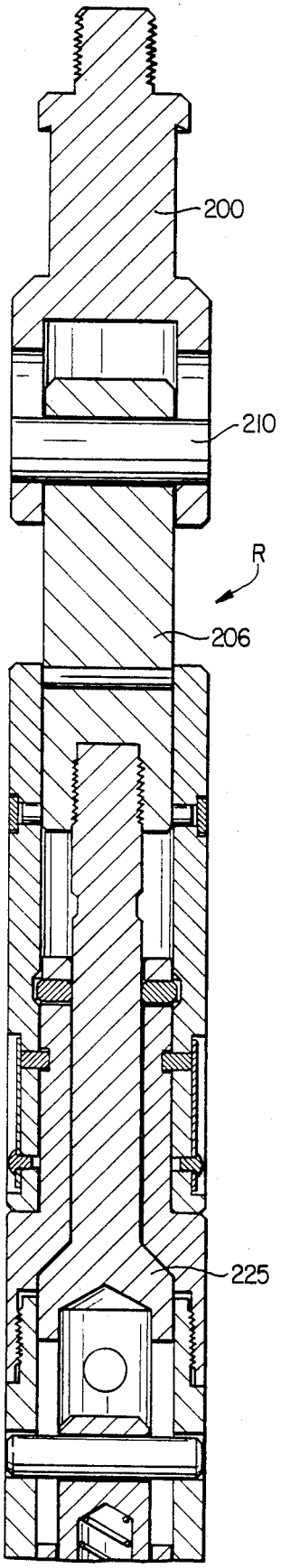
FIGS. 21*a*–21B** together form a fragmentary longitudinal view in section of the running tool and lock mandrel at the fourth and final stage of operation of the emergency release of the lock mandrel and running tool.
Figure 21B:
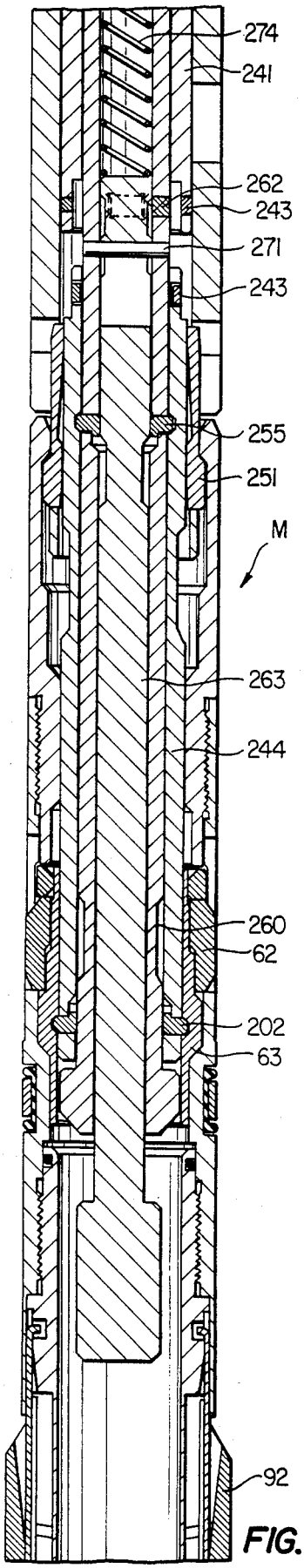

In the event of an obstruction in the flow conductor or some other malfunction which prevents full expansion and locking of the mandrel dogs 62, it is preferred that the running tool and lock mandrel be manipulated to retract the mandrel dogs and retrieve the lock mandrel M with the running tool R without releasing the lock mandrel and leaving it in the well bore. Such emergency release procedure is illustrated in FIGS. 18A and 18B through 21A and 21B. Referring to FIGS. 18A and 18B, the first step in the emergency release operation is to jar upwardly on the fishneck 200 of the running tool. Because the locking sleeve 63 cannot move upwardly due to jammed locking dogs 62, the operator lugs 202 engaged in the locking sleeve recess 81 cannot move upwardly holding the lower shifting sleeve 244 against upward movement. The upward jarring which starts with the tool in the operational mode of FIGS. 18A and 18B continuing as illustrated FIGS. 19A and 19B. It will be noted in FIG. 18B that the locking sleeve 63 is at the initial stage of upward movement and has moved only partially enough to begin the initial expansion of the locking dogs 62. The upward jarring on the fishneck 200 is transmitted through the transfer pin 210 and the retainer core 206 to the upper shifting sleeve 225. The shear screws 243 connect the lower end of the upper shifting sleeve to the lower shifting sleeve 244 which is being held against upward movement by the lugs 202. The screws 243 shear releasing the upper shifting sleeve section 241 of the sleeve 225 to move upwardly away from the lower shifting sleeve 244 as represented in FIG. 19B. The separation of the upper and lower shifting sleeves allows the upper shifting sleeve to move upwardly to the position of FIGS. 19B at which the lugs 262 in the outer core 252 are free to move radially outwardly from engagement in the recess 265 of the inner core 263. The inner core is spring biased downwardly by the spring 274. As seen in FIGS. 19A–19B, the lugs 255 are urged outwardly by the cam surface at the upper end of the recess 272 around the inner core 263. The lugs 255 are, however, held inwardly by the lower shifting sleeve 244 which is parted from the upper shifting sleeve. The fishneck 200 on the running tool is lowered back downwardly lowering the upper shifting sleeve portion 241 which reengages the lower shifting sleeve 244 pushing the lower shifting sleeve downwardly so that the lugs 202 in the lower shifting sleeve move the lock mandrel locking sleeve 63 downwardly to the lower release position at which the lock mandrel locking dogs 62 may move radially inwardly to full release positions as seen in FIG. 20B. As the lower shifting sleeve moves downwardly, the recess 250 in the lower shifting sleeve aligns with the lugs 255 which are cammed outwardly into the recess 250 by the downward force of the spring 274 on the inner core 263. The lugs 255 move outwardly from the inner core recess 272 into the lower shifting sleeve latch recess 250. The inner core then moves further downwardly to the position of FIG. 20B at which the lugs 255 are locked in the outward position at which they latch the lower shifting sleeve 244 at the lower release position at which lock mandrel dogs 63 are inward and the latch keys 251 on the running tool are held by the lower shifting sleeve outward in the recess 42 of the fishneck of the lock mandrel M. The running tool fishneck is then lifted back upwardly as seen in FIGS. 21A and 21B, pulling the retainer core 206 and the upper shifting sleeve 225 back upwardly. Since the shear screws 243 between the upper and lower shifting sleeve are severed the upper shifting sleeve moves upwardly leaving the lower shifting sleeve in the downward position, of FIG. 21B so that the lock mandrel dogs 62 remain unlocked and the latch keys 251 of the running tool remain locked with the fishneck of the lock mandrel M. Because the lugs 255 are holding the lower shifting sleeve 244 in the downward position the lower shifting sleeve cannot be pulled back upwardly. The running tool is pulled back to the surface with the lock mandrel M coupled to the running tool as represented in FIGS. 21A and 21B.

It will now be seen that a new and improved lock mandrel for locking a well tool at a selected landing nipple in a well bore and a running tool for installing the lock mandrel have been described and illustrated. The lock mandrel includes selective keys in an assembly providing a maximum bore through the lock mandrel for well fluid flow. The running tool includes structure which permits the running and setting of the lock mandrel and release from the lock mandrel without requiring any cooperative relationship between the running tool and the well tool supported from the lock mandrel for release of the running tool from the lock mandrel. Additionally, the running tool includes structure providing for use of a non-load bearing shear pin during the running mode minimizing accidental release of the running tool through shearing of the pin prematurely. The running tool also includes emergency release apparatus for releasing the lock mandrel in the well bore for retrieval with the running tool where the locking dogs on the lock mandrel will not fully expand.

What is claimed is:

1. A lock mandrel and running tool assembly for setting and locking a well tool-at a selected landing nipple along a well bore comprising:

a lock mandrel having a body provided with side window means and an internal fishneck along an upper end thereof;

radially movable locking dog means in said side window means;

a longitudinally movable expander sleeve in said body movable within said dog means for expanding and locking said dog means and releasing said dog means, said expander sleeve having an internal annular recess for engagement by an operating lug on said running tool to move said sleeve upwardly and downwardly and an external annular latch boss along an upper end portion thereof for releasably latching said expander sleeve at an upper locking position, said expander sleeve having a longitudinal bore there through having a diameter at least as large as the minimum diameter of the bore through said lock mandrel body;

a latch ring in said body around said expander sleeve above said locking dog means for engagement with said latch boss on said sleeve when said sleeve is at an upper locking position to releasably hold said sleeve in said upper position;

locator key means on said body spaced from said locking dog means having an external defined profile configured to engage an internal locator profile in said selected landing nipple;

longitudinal leaf spring means within said locator key means for holding said locator key means at outward positions for engagement with said selected landing nipple and permitting said locator key means to move inwardly to pass through landing nipples having an internal profile different from said locator profile on said locator key means; and a running tool for installing said lock mandrel comprising:

a head assembly including a fishneck;

a latch key assembly for coupling said lock mandrel on said running tool;

mounting means supporting said latch key assembly on said running tool for operation between latch and release modes;

lock mandrel operator lug means for locking and releasing said lock mandrel in a landing nipple;

means mounting said operator lug means on said running tool and coupling said operator lug means with said latch key assembly;

non-weight bearing coupling means and release-lockout means connected between said head assembly and said latch key assembly and said operator lug means for holding said latch key assembly in a running mode latched with said lock mandrel and said lock mandrel in a release mode while installing said lock mandrel; and said release-lockout means being operable responsive to a downward jar to activate said lockout means for locking said lock mandrel in a landing nipple and for release of said latch key means from said lock mandrel for retrieving said running tool.

2. The system of claim 1 where said release-lockout means includes a top sub on said head assembly for locking said running tool at said running mode and a lockout pin assembly on said top sub for holding said top sub at a lockout position while locking said lock mandrel in said landing nipple and releasing said running tool from said lock mandrel.

3. The system of claim 2 including non-weight bearing shear pins means holding said top sub at a position at which said running tool is in said running mode.

4. The system of claim 3 including emergency release means coupled with said mandrel operator lug means to disable said lug means for removal of said running tool and said lock mandrel when said locking dog means on said lock mandrel are only partially expanded.

5. The system of claim 4 wherein said emergency release means includes upper and lower shifting sleeves coupled with said latch keys means and said operator lug means and shear screw means between said shifting sleeves to disable said lower shifting sleeve whereby said running tool is pulled back upwardly without re-expanding said locking dogs on said lock mandrel and disconnecting said latch key means from said lock mandrel fishneck.

6. A system in accordance with claim 5 including a spring biased inner core within said upper and lower shifting sleeves and lower shifting sleeve latch lug means operable by said inner core for latching said lower shifting sleeve at an inoperative position.

7. A system in accordance with claim 6 including an outer core on said inner core and slidable within said upper and lower shifting sleeves and lug means between said inner and outer cores for latching said inner core at a position within said outer core for holding said lower shifting sleeve at said inoperative position.

8. A lock mandrel and running tool assembly for setting and locking a well tool in a landing nipple along a well bore comprising:

a lock mandrel having a body provided with a longitudinal bore therethrough, an internal fishneck along an upper end portion of said body around said bore, and side window means opening into said bore;

radially movable locking dog means in said side window means;

a longitudinally movable expander sleeve in said body bore movable within said dog means for expanding and locking said dog means outwardly and releasing said dog means for inward movement, said expander sleeve having an internal annular recess for engagement by a handling tool to move said sleeve upwardly and downwardly, the bore through said expander sleeve being equal in diameter to the minimum bore through said lock mandrel body, said expander sleeve having an external annular latch boss along an upper end portion thereof;

a latch ring in said body around said expander sleeve above said locking dog means for engagement with said latch boss on said sleeve when said sleeve is at an upper locking position to releasably hold said sleeve in said upper position;

a tubular locator key retainer connected into the lower end of said mandrel body, said locator key retainer having longitudinal outwardly opening recesses;

a locator key in each of said recesses having an external annular locator profile for engagement with a compatible internal profile in a selected landing nipple along said well bore, each said locator key having longitudinal slots therein;

cam surfaces on said locator key retainer and on each said locator keys coengageable to cam said keys outwardly as said mandrel moves down a bore hole;

a longitudinal leaf spring coupled through said slots in said selector keys into said slots in said locator key retainer for resiliently holding each said locator key in .a radially outward position to seek a compatible landing nipple profile as said lock mandrel moves downwardly in said well bore and permitting each said key to move inwardly as said keys pass through incompatible landing nipple profiles, said leaf springs urging said locator keys outwardly into said selected compatible landing nipple profile;

the bore through said locator key retainer being equal in diameter to the bore through said lock mandrel body; and said running tool including a head for connection with an operating tool string, said head having a downwardly opening blind bore and longitudinal, oppositely positioned, slots opening into said bore;

a retainer core having an upper end portion telescoped into said bore of said head for longitudinal movement therein;

a transverse transfer pin secured through said retainer core having opposite ends extending into said longitudinal slots of said head permitting limited longitudinal movement of said retainer core in said head;

an upper shifting sleeve having a reduced upper end portion secured into the lower end of said retainer core for longitudinal movement with said retainer core, said upper end portion of said upper shifting sleeve having an external annular latch lug recess below the lower end of said retainer core, said upper shifting sleeve having longitudinal oppositely positioned, slots below said reduced upper end portion;

a lower shifting sleeve secured by shear screw means into the lower end of said upper shifting sleeve, said lower shifting sleeve having an external annular latch key release recess and an internal emergency release latch lug recess;

operator lug means along the lower end portion of said lower shifting sleeve operable in lateral windows of said lower shifting sleeve for engagement with said locking sleeve of said lock mandrel for moving said locking sleeve upwardly and downwardly for locking and releasing said lock mandrel; and a tubular top sub slidable on said retainer core below said head, a lower end portion of said top sub extending below the lower end of said retainer core and having an internal latch lug release recess therein below said lower end of said retainer core, said lower end portion of said top sub being spaced from said reduced upper end portion of said upper shifting sleeve defining an annular space between said upper end portion of said shifting sleeve and said lower end portion of said top sub;

a lockout pin assembly mounted along said lower end portion of said top sub including a laterally movable spring biased lockout pin adapted to move inwardly into said annular space between said top sub and said reduced upper end portion of said upper shifting sleeve;

a tubular upper lug retainer slidably telescoped between said lower end portion of said top sub and said reduced upper end portion of said upper shifting sleeve, said retainer having lateral lug window means and an external annular lockout pin recess for receiving said lockout pin on said top sub when said top sub is moved on said retainer to a lower inoperative position;

a non-load bearing shear pin extending laterally through said top sub and said retainer core for holding said top sub on said retainer core at an upper operating position while running said running tool into said well bore;

lug means in said window means in said upper lug retainer, said lug means being held at an inward latching position with said latch recess around said reduced upper end portion of said upper shifting sleeve when said top sub is held by said shear pin at said first upper position and said lug means being releasable outwardly into said release recess within said top sub when said top sub is at said lower end position held by said lockout pin;

a tubular latch key retainer connected at an upper end into said upper lug retainer around said upper and lower shifting sleeves, said latch key retainer having downwardly and outwardly opening latch key windows along a lower end portion thereof;

latch key means in said windows of said latch key retainer for lateral movement inwardly to release positions and outwardly to latch positions for connection in said internal fishneck of said lock mandrel, said latch key means being movable inwardly when said lower shifting sleeve is at an upper position at which said latch key release recess around said lower shifting sleeve is aligned within said latch keys means;

an outer tubular core telescoped through said lower shifting sleeve into said upper shifting sleeve, said outer core having an external annular operator lug release recess along a lower end portion for releasing said operator lugs in said lower shifting sleeve and said core having upper and lower latch lug windows aligned within said lower shifting sleeve;

latch lug means in said lower latch lug windows of said outer core for outward movement to latching positions in said internal latch recess of said lower shifting sleeve to latch said lower shifting sleeve at an inoperative position for emergency removal of said running tool and lock mandrel;

a lateral retainer pin extending through an upper end portion of said outer core and into said latch key retainer coupling said outer core with said dog retainer, said retainer pin extending through said longitudinal recesses of said upper shifting sleeve permitting upper shifting sleeve to move relative to said latch key retainer and said outer core;

an inner core telescoped in slidable relation into said outer core, said inner core having longitudinally spaced external annular lug recesses for said lug means in said lower windows of said outer core between said inner core and said lower shifting sleeve through said windows in said outer core and for latch lug means between said inner core and said outer core to latch said inner core at a normal operating position and an emergency release position;

lug means in said upper windows of said outer core between said inner core and said outer core for locking said inner core at said emergency release position; and spring means in said outer core biasing an upper end of said inner core downwardly relative to said outer core.

9. A lock mandrel for setting and locking a well tool at a selected landing nipple along a well bore comprising:

a mandrel body provided with side window means and an internal fishneck along an upper end thereof;

radially movable locking dog means in said side window means;

a longitudinally movable expander sleeve in said body movable within said dog means for expanding and locking said dog means and releasing said dog means, said expander sleeve having an internal annular recess for engagement by an operating lug on a running tool to move said sleeve upwardly and downwardly and an external annular latch boss along an upper end portion thereof for releasably latching said expander sleeve at an upper locking position, said expander sleeve having a longitudinal bore there through having a diameter at least as large as the minimum diameter of the bore through said mandrel body;

a latch ring in said body around said expander sleeve above said locking dog means for engagement with said latch boss on said sleeve when said sleeve is at an upper locking position to releasably hold said sleeve in said upper position;

locator key means on said body spaced from said locking dog means having an external defined profile configured to engage an internal locator profile in said selected landing nipple, said locator key means having upper and lower end retainer flange portions and an internal longitudinal slot extending from a central portion of said key means upwardly and opening through an upper end of said key means and an external longitudinal slot communicating at an upper end with a lower end of said internal slot, said slots accommodating longitudinal leaf spring means;

longitudinal leaf spring means within said locator key means internal and external slots for holding said locator key means at outward positions for engagement with said selected landing nipple and permitting said locator key means to move inwardly to pass through landing nipples having an internal profile different from said locator profile on said locator key means, said leaf spring means being essentially flat and sized and shaped to fit within said slots of said locator key means and having an inwardly turned latch portion at an upper end thereof for latching into an external recess of said mandrel body for holding said leaf spring means longitudinally relative to said body.

10. A running tool for installing a lock mandrel in a landing nipple comprising:

a head assembly including a fishneck;

a latch key assembly for coupling said lock mandrel on said running tool;

mounting means supporting said latch key assembly on said running tool for operation between latch and release modes;

lock mandrel operator lug means for locking and releasing said lock mandrel in a landing nipple;

means mounting said operator lug means on said running tool and coupling said operator lug means with said latch key assembly;

non-weight bearing coupling means and release-lockout means connected between said head assembly and said latch key assembly and said operator lug means for holding said latch key assembly in a running mode latched with said lock mandrel and said lock mandrel in a release mode while installing said lock mandrel; and said release-lockout means being operable responsive to a downward jar to activate said lockout means for locking said lock mandrel in a landing nipple and for release of said latch key means from said lock mandrel for retrieving said running tool.

11. The tool of claim 10 where said release-lockout means includes a top sub on said head assembly for locking said running tool at said running mode and a lockout pin assembly on said top sub for holding said top sub at a lockout position while locking said lock mandrel in said landing nipple and releasing said running tool from said lock mandrel.

12. The tool of claim 11 including non-weight bearing shear pins means holding said top sub at a position at which said running tool is in said running mode.

13. The tool of claim 12 including emergency release means coupled with said mandrel operator lug means to disable said lug means for removal of said running tool and said lock mandrel when said locking dog means on said lock mandrel are only partially expanded.

14. The tool of claim 13 wherein said emergency release means includes upper and lower shifting sleeves coupled with said latch keys means and said operator lug means and shear screw means between said shifting sleeves to disable said lower shifting sleeve whereby said running tool is pulled back upwardly without re-expanding said locking dogs on said lock mandrel and disconnecting said latch key means from said lock mandrel fishneck.

15. The tool of claim 14 including a spring biased inner core within said upper and lower shifting sleeves and lower shifting sleeve latch lug means operable by said inner core for latching said lower shifting sleeve at an inoperative position.

16. The tool of claim 15 including an outer core on said inner core and slidable within said upper and lower shifting sleeves and lug means between said inner and outer cores for latching said inner core at a position within said outer core for holding said lower shifting sleeve at said inoperative position

17. A lock mandrel for setting and locking a well tool in a landing nipple along a well bore comprising:

a lock mandrel having a body provided with a longitudinal bore therethrough, an internal fishneck along an upper end portion of said body around said bore, and side window means opening into said bore;

radially movable locking dog means in said side window means;

a longitudinally movable expander sleeve in said body bore movable within said dog means for expanding and locking said dog means outwardly and releasing said dog means for inward movement, said expander sleeve having an internal annular recess for engagement by a handling tool to move said sleeve upwardly and downwardly, the bore through said expander sleeve being equal in diameter to the bore through said lock mandrel body, said expander sleeve having an external annular latch boss along an upper end portion thereof;

a latch ring in said body around said expander sleeve above said locking dog means for engagement with said latch boss on said sleeve when said sleeve is at an upper locking position to releasably hold said sleeve in said upper position;

a tubular locator key retainer connected into the lower end of said mandrel body, said locator key retainer having longitudinal outwardly opening recesses;

a locator key in each of said recesses having an external annular locator profile for engagement with a compatible internal profile in a selected landing nipple along said well bore, each said locator key having longitudinal slots therein;

cam surfaces on said location key retainer and on each said locator keys coengageable to cam said keys outwardly as said mandrel moves down a bore hole;

a longitudinal leaf spring coupled through said slots in said selector keys into said slots in said locator key retainer for resiliently holding each said locator key in a radially outward position to seek a compatible landing nipple profile as said lock mandrel moves downwardly in said well bore and permitting each said key to move inwardly as said keys pass through incompatible landing nipple profiles, said leaf springs urging said locator keys outwardly into said selected compatible landing nipple profile;

the bore through said locator key retainer being equal in diameter to the bore through said lock mandrel body.

18. A running tool for a lock mandrel including:

a head for connection with an operating tool string, said head having a downwardly opening blind bore and longitudinal, oppositely positioned, slots opening into said bore;

a retainer core having an upper end portion telescoped into said bore of said head for longitudinal movement therein;

a transverse transfer pin secured through said retainer core having opposite ends extending into said longitudinal slots of said head permitting limited longitudinal movement of said retainer core in said head;

an upper shifting sleeve having a reduced upper end portion secured into the lower end of said retainer core for longitudinal movement with said retainer core, said upper end portion of said upper shifting sleeve having an external annular latch lug recess below the lower end of said retainer core, said upper shifting sleeve having longitudinal oppositely positioned, slots below said reduced upper end portion;

a lower shifting sleeve secured by shear screw means into the lower end of said upper shifting sleeve, said lower shifting sleeve having an external annular latch key release recess and an internal emergency release latch lug recess;

operator lug means along the lower end portion of said lower shifting sleeve operable in lateral windows of said lower shifting sleeve for engagement with a locking sleeve of said lock mandrel for moving said locking sleeve upwardly and downwardly for locking and releasing said lock mandrel; and a tubular top sub slidable on said retainer core below said head, a lower end portion of said top sub extending below the lower end of said retainer core and having an internal latch lug release recess therein below said lower end of said retainer core, said lower end portion of said top sub being spaced from said reduced upper end portion of said upper shifting sleeve defining an annular space between said upper end portion of said shifting sleeve and said lower end portion of said top sub;

a lockout pin assembly mounted along said lower end portion of said top sub including a laterally movable spring biased lockout pin adapted to move inwardly into said annular space between said top sub and said reduced upper end portion of said upper shifting sleeve;

a tubular upper lug retainer slidably telescoped between said lower end portion of said top sub and said reduced upper end portion of said upper shifting sleeve, said retainer having lateral lug window means and an external annular lockout pin recess for receiving said lockout pin on said top sub when said top sub is moved on said retainer to a lower inoperative position;

a non-load bearing shear pin extending laterally through said top sub and said retainer core for holding said top sub on said retainer core at an upper operating position while running said running tool into said well bore;

lug means in said window means in said upper lug retainer, said lug means being held at an inward latching position with said latch recess around said reduced upper end portion of said upper shifting sleeve when said top sub is held by said shear pin at said first upper position and said lug means being releasable outwardly into said release recess within said top sub when said top sub is at said lower end position held by said lockout pin;

a tubular latch key retainer connected at an upper end into said upper lug retainer around said upper and lower shifting sleeves, said latch key retainer having downwardly and outwardly opening latch key windows along a lower end portion thereof;

latch key means in said windows of said latch key retainer for lateral movement inwardly to release positions and outwardly to latch positions for connection in an internal fishneck of said lock mandrel, said latch key means being movable inwardly when said lower shifting sleeve is at an upper position at which said latch key release recess around said lower shifting sleeve is aligned within said latch keys means;

an outer tubular core telescoped through said lower shifting sleeve into said upper shifting sleeve, said outer core having an external annular operator lug release recess along a lower end portion for releasing said operator lugs in said lower shifting sleeve and said core having upper and lower latch lug windows aligned within said lower shifting sleeve;

latch lug means in said lower latch lug windows of said outer core for outward movement to latching positions in said internal latch recess of said lower shifting sleeve to latch said lower shifting sleeve at an inoperative position for emergency removal of said running tool and lock mandrel;

a lateral retainer pin extending through an upper end portion of said outer core and into said latch key retainer coupling said outer core with said dog retainer, said retainer pin extending through said longitudinal recesses of said upper shifting sleeve permitting upper shifting sleeve to move relative to said latch key retainer and said outer core;

an inner core telescoped in slidable relation into said outer core, said inner core having longitudinally spaced external annular lug recesses for said lug means in said lower windows of said outer core between said inner core and said lower shifting sleeve through said windows in said outer core and for latch lug means between said inner core and said outer core to latch said inner core at a normal operating position and an emergency release position;

lug means in said upper windows of said outer core between said inner core and said outer core for locking said inner core at said emergency release position; and spring means in said outer core biasing an upper end of said inner core downwardly relative to said outer core.

19. A running tool for installing a lock mandrel at a landing nipple in a well bore comprising:

a head assembly for supporting the running tool from an operating tool string;

an outer tubular body assembly coupled with the head assembly;

a latch key assembly on the body assembly for releasably coupling the running tool with a lock mandrel;

an operator lug assembly on the body assembly for operating the lock mandrel to lock the lock mandrel at a landing nipple;

a core assembly in the body assembly coupled with the head assembly for manipulating the latch key assembly and the operator lug assembly for landing and locking the lock mandrel and thereafter releasing the running tool from the lock mandrel;

a non-load bearing shear pins means coupling the outer tubular body assembly with the core assembly; and a releasable latch lug means between the tubular body assembly and the core for supporting the load of the lock mandrel and the well device connected to the lock mandrel during the running mode through the outer body assembly and the upper end of the core to the head assembly bypassing the shear pin and for transferring such load to the core assembly from the outer tubular body assembly after severance of the shear pin for setting the lock mandrel and for releasing the running tool from the lock mandrel.

20. A running tool in accordance with claim 19 including emergency release apparatus coupled with said core assembly and said latch key assembly and said operator lug assembly for emergency release and retrieval of said lock mandrel when said lock mandrel is not operable for locking at a landing nipple.

* * * * *